US008712061B2

(12) United States Patent
Jot et al.

(10) Patent No.: US 8,712,061 B2
(45) Date of Patent: Apr. 29, 2014

(54) PHASE-AMPLITUDE 3-D STEREO ENCODER AND DECODER

(75) Inventors: Jean-Marc Jot, Aptos, CA (US); Martin Walsh, Scotts Valley, CA (US); Edward Stein, Capitola, CA (US); Juha Oskari Merimaa, Menlo Park, CA (US); Michael M. Goodwin, Scotts Valley, CA (US)

(73) Assignee: Creative Technology Ltd, Singapore (SG)

( * ) Notice: Subject to any disclaimer, the term of this patent is extended or adjusted under 35 U.S.C. 154(b) by 1028 days.

(21) Appl. No.: 12/246,491

(22) Filed: Oct. 6, 2008

(65) Prior Publication Data

US 2009/0092259 A1 Apr. 9, 2009

Related U.S. Application Data

(63) Continuation-in-part of application No. 12/047,285, filed on Mar. 12, 2008, now Pat. No. 8,345,899, which is a continuation-in-part of application No. 11/750,300, filed on May 17, 2007, now Pat. No. 8,379,868, said application No. 12/246,491 is a continuation-in-part of application No. 12/243,963, filed on Oct. 1, 2008, now Pat. No. 8,374,365.

(60) Provisional application No. 60/977,432, filed on Oct. 4, 2007, provisional application No. 61/102,002, filed on Oct. 1, 2008, provisional application No. 60/747,532, filed on May 17, 2006, provisional application No. 60/894,437, filed on Mar. 12, 2007, provisional application No. 60/977,432, filed on Oct. 4, 2007, provisional application No. 60/977,345, filed on Oct. 3, 2007.

(51) Int. Cl.
*H04R 5/00* (2006.01)

(52) U.S. Cl.
USPC ..... 381/23; 381/17; 381/18; 381/22

(58) Field of Classification Search
USPC ..... 381/17, 18, 22, 23
See application file for complete search history.

(56) References Cited

U.S. PATENT DOCUMENTS 5,598,478 A * 1/1997 Tanaka et al. ..... 381/17
5,633,981 A 5/1997 Davis (Continued)

FOREIGN PATENT DOCUMENTS

WO 2007031896 A1 3/2007

OTHER PUBLICATIONS

Christof Faller, 'Parametric Coding of Spatial Audio', Proc. of the 7th Int. Conf. DAFx'04, Napoles, Italy, Oct. 5-8, 2004.

*Primary Examiner* — S. V. Clark
*Assistant Examiner* — Jesse Y Miyoshi
(74) *Attorney, Agent, or Firm* — Creative Technology Ltd

(57) ABSTRACT

A two-channel phase-amplitude stereo encoding and decoding scheme enabling flexible and spatially accurate interactive 3-D audio reproduction via standard audio-only two-channel transmission. The encoding scheme allows associating a 2-D or 3-D positional localization to each of a plurality of sound sources by use of frequency independent inter-channel phase and amplitude differences. The decoder is based on frequency-domain spatial analysis of 2-D or 3-D directional cues in a two-channel stereo signal and re-synthesis of these cues using any preferred spatialization technique, thereby allowing faithful reproduction of positional audio cues and reverberation or ambient cues over arbitrary multi-channel loudspeaker reproduction formats or over headphones, while preserving source separation despite the intermediate encoding over only two audio channels.

8 Claims, 7 Drawing Sheets

(56) References Cited

U.S. PATENT DOCUMENTS

| | | | | |
|---|---|---|---|---|
| 5,857,026 | A * | 1/1999 | Scheiber | 381/23 |
| 5,890,125 | A | 3/1999 | Davis et al. | |
| 7,853,022 | B2 | 12/2010 | Thompson et al. | |
| 7,970,144 | B1 | 6/2011 | Avendano et al. | |
| 2006/0106620 | A1 | 5/2006 | Thompson et al. | |
| 2008/0002842 | A1 | 1/2008 | Neusinger et al. | |
| 2008/0205676 | A1 | 8/2008 | Merimaa et al. | |
| 2008/0267413 | A1 | 10/2008 | Faller | |
| 2009/0129601 | A1 | 5/2009 | Ojala et al. | |
| 2009/0150161 | A1 | 6/2009 | Faller | |

* cited by examiner

PHASE-AMPLITUDE 3-D STEREO ENCODER AND DECODER

CROSS-REFERENCE TO RELATED APPLICATIONS

This application claims priority to and the benefit of the disclosures of U.S. Provisional Patent Application Ser. No. 60/977,432, filed on Oct. 4, 2007, and entitled "Phase-Amplitude Stereo Decoder and Encoder", and of U.S. Provisional Patent Application Ser. No. 61/102,002, filed on Oct. 1, 2008, and entitled "Phase-Amplitude Stereo Decoder and Encoder", the disclosures of which are incorporated by reference herein.

This application is a continuation-in-part of U.S. patent application Ser. No. 11/750,300, which is entitled Spatial Audio Coding Based on Universal Spatial Cues, and filed on May 17, 2007 which claims priority to and the benefit of the disclosure of U.S. Provisional Patent Application Ser. No. 60/747,532, filed on May 17, 2006, and entitled "Spatial Audio Coding Based on Universal Spatial Cues", the disclosures of which are incorporated herein by reference in their entirety. Further, this application is a continuation-in-part of U.S. patent application Ser. No. 12/047,285 which is entitled Phase-Amplitude Matrixed Surround Decoder, and filed on Mar. 12, 2008 which claims priority to and the benefit of the disclosures of U.S. Provisional Patent Application Ser. No. 60/894,437, filed on Mar. 12, 2007, and entitled "Phase-Amplitude Stereo Decoder and Encoder" and of U.S. Provisional Patent Application Ser. No. 60/977,432, filed on Oct. 4, 2007, and entitled "Phase-Amplitude Stereo Decoder and Encoder", all of the disclosures of which are incorporated by reference herein.

This application is a continuation in part of the U.S. application Ser. No. 12/243,963, filed Oct. 1, 2008 and entitled "Spatial Audio Analysis and Synthesis for Binaural Reproduction and Format Conversion", which claims priority to and the benefit of the disclosures of U.S. Provisional Patent Application Ser. No. 60/977,345, filed on Oct. 3, 2007 and entitled "Spatial Audio Analysis and Synthesis for Binaural Reproduction, the entire disclosures of which are incorporated by reference for all purposes herein.

BACKGROUND OF THE INVENTION

1. Field of the Invention

The present invention relates to signal processing techniques. More particularly, the present invention relates to methods for processing audio signals.

2. Description of the Related Art

Two-channel phase-amplitude stereo encoding, also known as "matrixed surround encoding" or "matrix encoding", is widely used for connecting the audio output of a video gaming system to a home theater system for multichannel surround sound reproduction, and for low-bandwidth or two-channel transmission or recording of surround sound movie soundtracks. Typically, in the gaming application, a multichannel audio mix is computed in real time (during game play) by an interactive audio spatialization engine and downmixed to two channels by use of a matrixed surround encoding process identical to those used for matrix encoding multichannel movie soundtracks. As a result of the encoding-decoding process, schematically illustrated in FIG. 1A, the surround sound mix can be transmitted via a single standard stereo audio connection or via a S/PDIF coaxial or optical cable connection commonly available in current home theater equipment. The multichannel mix composed in the interactive audio rendering engine is typically obtained as a combination (mixing) of localized sound components reproducing point sources (primary sound components) and of reverberation or spatially diffuse sound components (ambient sound components).

An advantage of phase-amplitude stereo encoding compared to alternative discrete multi-channel audio data formats (such as Dolby Digital or DTS) is that the encoded data stream is a two-channel audio signal that can be played back directly (without any decoding) over standard two-channel stereo loudspeakers or headphones. For multichannel loudspeaker presentation, a matrixed surround decoder can be used to recover a multichannel signal from the matrix-encoded two-channel signal. However, with currently available time-domain matrixed surround decoders, the fidelity of the spatial reproduction typically suffers from inaccurate source loudness reproduction, inaccurate spatial reproduction, localization steering artifacts, and lack of "discreteness" (or "source separation"), when compared to direct multi-channel reproduction without matrixed surround encoding/decoding.

MPEG Surround technology enables the transmission, over one low-bit-rate digital audio connection, of a two-channel matrix-encoded signal compatible with existing commercial matrixed surround decoders, along with an auxiliary spatial information data stream that an MPEG Surround decoder utilizes in order to recover a faithful reproduction of the original discrete multi-channel mix. However, the transmission of auxiliary data along with the audio signal requires a new digital connection format incompatible with standard stereo equipment.

Another limitation of the above audio encoding-decoding technologies is their restriction to horizontal-only spatialization, their bias towards a particular multi-channel loudspeaker layout, and their reliance on the spatial audio rendering technique known as multi-channel amplitude panning. This makes these technologies non-ideal for reproduction using headphones or alternative loudspeaker layouts and spatialization techniques (such as ambisonic or binaural technologies, for instance), which are more effective than the amplitude panning technique for improved spatial audio reproduction in some listening conditions. For headphone playback, in particular, a superior listening experience could be obtained by use of binaural 3-D audio spatialization methods, also requiring only two audio transmission channels. However, due to the inclusion of head-related inter-channel delay and frequency-dependent amplitude difference cues in the encoded signal, a binaural transmission format would be unsuited to multi-channel surround sound reproduction over an extended home theater listening area.

It is desired to overcome the above limitations of existing matrixed surround encoding and decoding technology by providing more flexible and spatially accurate encoding and decoding schemes.

SUMMARY OF THE INVENTION

In accordance with one embodiment of the present invention, provided is a method for two-channel phase-amplitude stereo encoding of one or more sound sources, in the time domain or in the frequency domain, such that the energy of each sound source is preserved in the matrix encoded signal.

In accordance with another embodiment of the present invention, provided is a method, operating in the time domain or in the frequency domain, for two-channel phase-amplitude stereo encoding of one or more localized sound sources and one or more unlocalized sound sources such that the contribution of an unlocalized source in the matrix encoded signal is substantially uncorrelated between the left and right encoded output channels.

In accordance with another embodiment of the present invention, provided is a method for two-channel phase-amplitude stereo encoding of one or more localized sound sources, operating in the time domain or in the frequency domain, such that each sound source is assigned a localization in three dimensions (including up-down discrimination in addition to left-right and front-back discrimination) by use of frequency-independent inter-channel phase and amplitude differences.

In accordance with another embodiment of the invention, provided is a frequency-domain method for phase-amplitude stereo decoding of a two-channel stereo signal, including frequency-domain spatial analysis of 2-D or 3-D localization cues in the recording and re-synthesis of these localization cues using any preferred spatialization technique, thereby allowing faithful reproduction of 2-D or 3-D positional audio cues and reverberation or ambient cues over headphones or arbitrary multi-channel loudspeaker reproduction formats, while preserving source separation despite prior encoding over only two audio channels.

These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

Matrixed Surround Principles

Figure 1A:
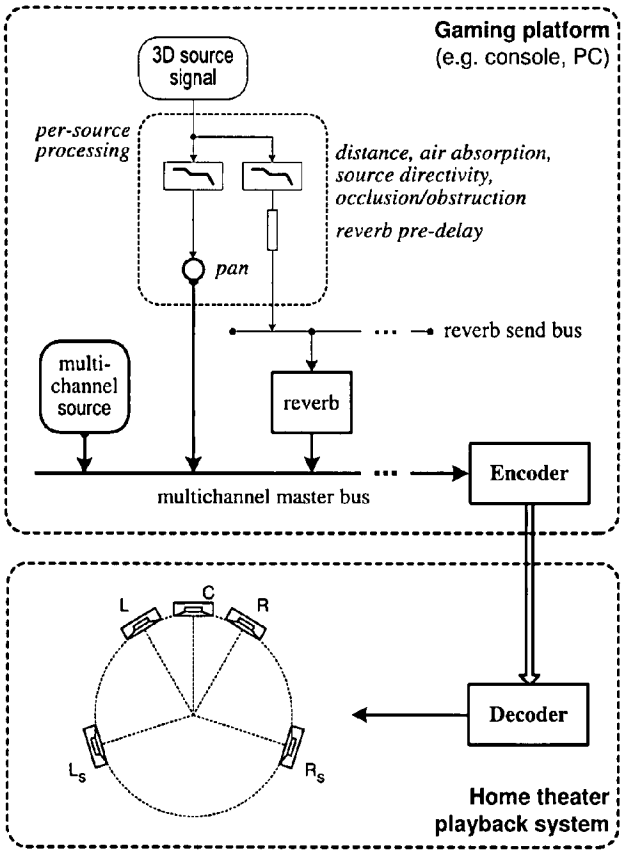
Fig. 1A (prior art)
FIG. 1A is a simplified functional diagram of an interactive gaming audio engine with single-cable audio output connection to a home theater system for audio playback in a standard 5-channel horizontal-only surround sound reproduction format.
Figure 1B:
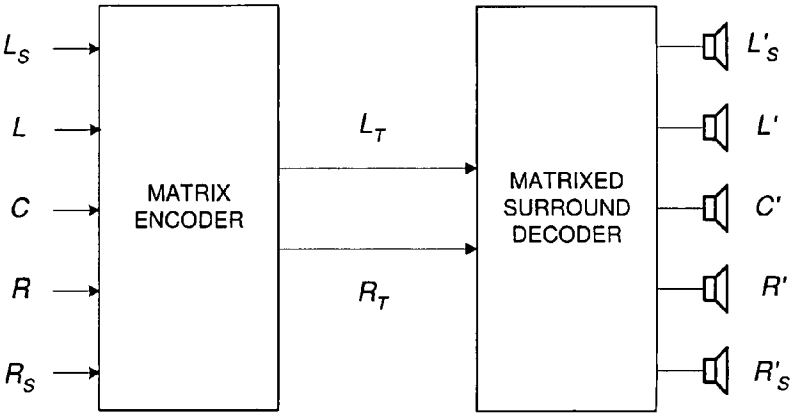
Fig. 1B (prior art)
FIG. 1B is a diagram illustrating a prior-art 5-2-5 matrixed surround encoding-decoding scheme where a 5-channel recording feeds a multichannel matrixed surround encoder to produce a 2-channel matrix-encoded signal and the matrix-encoded signal then feeds a matrixed surround decoder to produce 5 output signals for reproduction over loudspeakers.

FIG. 1B depicts a 5-2-5 matrix encoding-decoding scheme where a 5-channel recording $\{L_s[t], L[t], C[t], R[t], R_S[t]\}$ feeds a multichannel matrixed surround encoder to produce the matrix-encoded 2-channel signal $\{L_T[t], R_T[t]\}$, and the matrix-encoded signal then feeds a matrixed surround decoder to produce a 5-channel loudspeaker output signal $\{L_s'[t], L'[t], C'[t], R'[t], R_S'[t]\}$ for reproduction. In general, the purpose of such a matrix encoding-decoding scheme is to reproduce a listening experience that closely approaches that of listening to the original N-channel signal over loudspeakers located at the same N positions around a listener.

Multichannel Matrixed Surround Encoding Equations

Figure 1C:
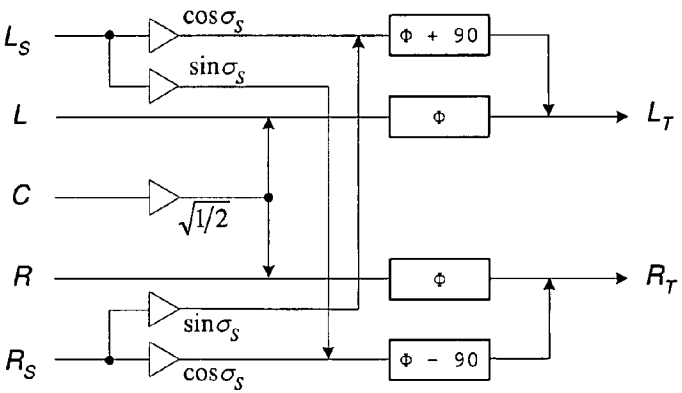
Fig. 1C (prior art)
FIG. 1C is a diagram illustrating a prior-art multichannel matrixed surround encoder for encoding 2-D positional audio cues into a two-channel signal, from a source in a standard 5-channel horizontal-only spatial audio recording format.

FIG. 1C depicts a multichannel phase-amplitude matrixed surround encoder for encoding 2-D positional audio cues into a two-channel signal by downmixing a 5-channel signal in the standard horizontal-only "3-2 stereo" format ($L_S$, L, C, R, $R_S$) corresponding to the loudspeaker layout depicted in FIG. 1A. The general form of the phase-amplitude matrixed surround encoding equations in this case is:

$$L_T=L+\sqrt{1/2}C+j(\cos\sigma_S L_S+\sin\sigma_S R_S)$$

$$R_T=R+\sqrt{1/2}C-j(\sin\sigma_S L_S+\cos\sigma_S R_S) \quad (1.)$$

where j denotes an idealized 90-degree phase shift and the angle $\sigma_S$ is within [0, π/4]. A common choice for $\sigma_S$ is 29 degrees, which yields:

$$\cos\sigma_S=0.875;\ \sin\sigma_S=0.485 \quad (2.)$$

As illustrated in FIG. 1C, the relative 90-degree phase shift applied on the surround channels $L_S$ and $R_S$ in equation (1) is commonly realized by use of an all-pass filter applying a phase shift Φ on the front input channels and an all-pass filter applying a phase shift Φ+90 degrees on the surround channels.

Passive Matrixed Surround Decoding Equations

For any phase-amplitude encoding matrix, a "passive" decoding matrix can be defined as the Hermitian transpose of the encoding matrix. If the encoding equations (1) are formulated in matrix form:

$$[L_T R_T]^T=E[L_S LCRR_S]^T, \quad (3.)$$

then the passive decoding equations produce five corresponding output channels as follows:

$$[L_S' L' C' R' R_S']^T=E^H[L_T R_T]^T. \quad (4.)$$

Since the encoding matrix E is preferably energy-preserving (i.e. the sum of the squared left and right encoding coefficients in each column of E is unity), the diagonal coefficients of the combined 5×5 encoding/decoding matrix $E^H E$ are all unity. This implies that each channel of the original multichannel signal is exactly transmitted to the corresponding decoder output channel. However, each decoder output channel also receives significant additional contributions (i.e. "bleeding") from the other encoder input channels, which results in significant spatial audio reproduction discrepancy between the original multichannel signal $\{L_S, L, C, R, R_S\}$ and the reproduced signal $\{L_S', L', C', R', R_S'\}$ after matrixed surround encoding and decoding.

Active Matrixed Surround Decoders

By varying the coefficients of the decoding matrix, an active matrixed surround decoder can improve the "source separation" performance compared to that of a passive matrixed surround decoder in conditions where the matrix-encoded signal presents a strong directional dominance. This enhancement is achieved by a "steering logic" which continuously adapts the decoding matrix according to a measured dominance vector, denoted by $\delta=(\delta_x, \delta_y)$, which can be derived from the 4-channel passive matrixed surround decoder output signals $L'=L_T$, $R'=R_T$, $C'=0.7(L'+R')$, and $S'=0.7(L'-R')$, as follows:

$$\delta_x=(|R'|^2-|L'|^2)/(|R'|^2+|L'|^2)$$

$$\delta_y=(|C'|^2-|S'|^2)/(|C'|^2+|S'|^2), \quad (5.)$$

where the squared norm $|.|^2$ denotes signal power. The magnitude of the dominance vector $|\delta|=(\delta_x^2+\delta_y^2)^{1/2}$ measures the degree of directional dominance in the encoded signal and is never more than 1.

Figure 2B:
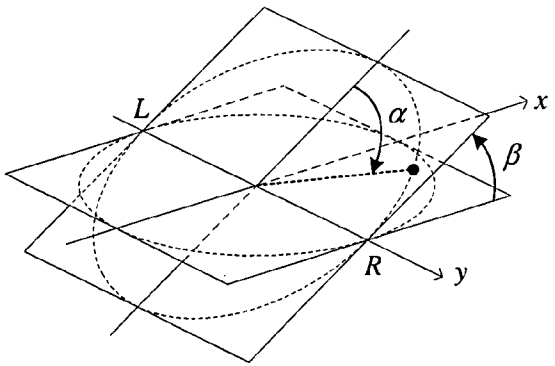
Fig. 2B (prior art)
FIG. 2B is a diagram illustrating phase-amplitude matrixed surround encoding on a notional encoding sphere known as the "Scheiber sphere," as described in the prior art, represented by the amplitude panning angle $\alpha$ and the inter-channel phase-difference angle $\beta$.
Figure 2A:
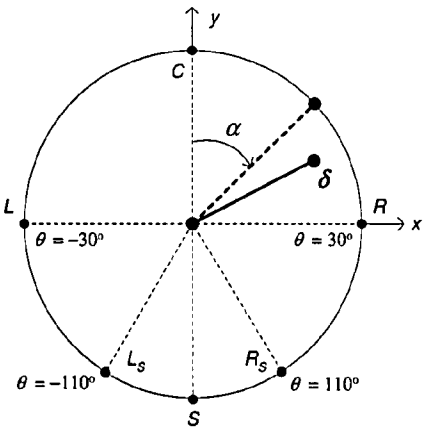
Fig. 2A (prior art)
FIG. 2A is a diagram illustrating peripheral phase-amplitude matrixed surround encoding according to the amplitude panning angle $\alpha$ on a notional encoding circle in the horizontal plane, and the dominance vector $\delta$ used in active matrixed surround decoders, as described in the prior art. The values of the physical azimuth angle $\theta$ are indicated for standard loudspeaker locations in the horizontal plane.

The effect of the steering logic is to redistribute signal power towards the channels indicated by the direction of the dominance vector δ observed on the encoding circle, as illustrated in FIG. 2A. When the magnitude |δ| of the dominance vector is near zero, an active matrixed surround decoder must revert to the passive behavior described previously (or using some other passive matrix). This occurs whenever the signals $L_T$ and $R_T$ are uncorrelated or weakly correlated (i.e. contain mostly ambient components) or in the presence of a plurality of concurrent primary sound sources distributed around the encoding circle.

In general, prior art 5-2-5 matrix encoding/decoding schemes based on time-domain active matrixed surround decoders are able to accurately reproduce the pairwise amplitude panning of a single primary source anywhere on the encoding circle. However, they cannot produce an effective and accurate directional enhancement in the presence of multiple concurrent primary sound components, nor preserve the diffuse spatial distribution of ambient sound in the presence of a dominant primary source. In such situations, noticeable steering artifacts tend to occur (e.g. shifting of sound effect localization or narrowing of the stereo image in the presence of centered dialogue). For this reason, it is recommended for mixing engineers to monitor a matrix-encoded mix through the encode-decode chain in the studio, in order to detect and avoid the occurrence of such artifacts. However, this precaution is not possible in a gaming application where the mix is automatically driven by real-time game play.

Design Criteria

In order to characterize the performance of a matrixed surround encoding-decoding scheme in accordance with the present invention, it is useful to define general spatial synthesis principles applicable in the design of interactive audio rendering systems (for e.g. gaming, computer music or virtual reality), regardless of the spatial rendering technique or setup used. From these general principles, we shall derive spatial audio scene preservation requirements for the matrix encoding-decoding process, in terms of energetic and spatial properties of the primary and ambient sound components in the spatial audio scene, regardless of the playback context.

Spatial Audio Scene and Signal Model

Figure 3:
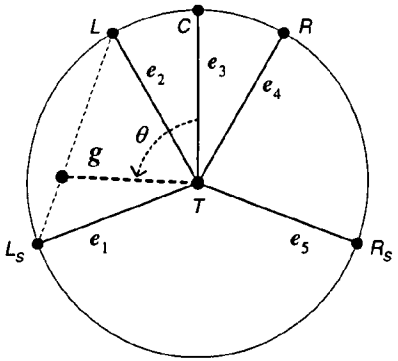
FIG. 3 is an illustration of the Gerzon vector on the listening circle in the horizontal plane, computed for a sound component amplitude-panned between loudspeaker channels L and $L_S$.

As illustrated in FIG. 1A, the multichannel signal representing the spatial audio scene can be modeled as a superposition of primary and ambient sound components. A primary component may be directionally encoded by use of a "panning" module (labeled pan in FIG. 1A) that receives a monophonic source signal and produces a multichannel signal for adding into the output mix. Generally defined, the role of this spatial panning module is to assign to the source a perceived direction observed on the listening sphere centered on the listener, while preserving source loudness and spectral content. In reproduction of an M-channel signal $P=[P_1 \ldots P_M]$ using loudspeakers, this perceived direction can be measured by the Gerzon vector g, defined as follows:

$$g=\Sigma_m p_m e_m \quad (6.)$$

where the "channel vector" $e_m$ is a unit vector in the direction of the m-th output channel (FIG. 3). The weights $p_m$ in equation (6) are given by:

$$p_m=P_m/\|P\|_1 \text{ for the "velocity vector"} \quad (7.)$$

$$p_m=|P_m|^2/\|P\|^2 \text{ for the "energy vector"} \quad (8.)$$

where $\|P\|_1$ denotes the amplitude-sum of the M-channel signal, and $\|P\|^2$ denotes its total signal power.

The Gerzon "velocity vector" defined by equations (6, 7) is proportional to the active acoustic intensity vector measured at the listening location. It is adequate for describing the perceived localization of primary components at low frequencies (below roughly 700 Hz) for a centrally located listener, whereas the "energy vector" defined by equations (6, 8) may be considered more adequate for representing the perceived sound localization at higher frequencies. Multi-channel sound spatialization techniques such as Ambisonics or VBAP can be regarded as different approaches to solving for the set of panning weights $p_m$ in equation (6) given the desired direction of the Gerzon vector. Spatialization techniques differ in their practical engineering compromises and in their ability to accurately control the magnitude of the Gerzon vector, which characterizes the spatial "sharpness" or "focus" of sound images and, when less than 1, may reflect interior panning across the loudspeaker array (such as a "fly-by" or "fly-over" sound event).

The Gerzon vector may also be applied for characterizing the directional distribution of ambient sound components in multichannel reproduction, such as room reverberation or spatially extended sound events (e.g. surrounding applause, or the more localized sound of a nearby waterfall). In this case, the loudspeaker signals should be mutually uncorrelated, and the Gerzon energy vector is then proportional to the active acoustic intensity. Its magnitude is zero for evenly distributed ambient sound and otherwise increases in the direction of spatial emphasis.

System Design Criteria

Based on the above principles, the design requirements for a matrix encode-decode system in terms of spatial audio scene reproduction can be formulated as follows: the power and the Gerzon vector direction of each individual sound component (primary or ambient) in the scene, hereafter referred to as the spatial cues associated to each sound source, should be correctly reproduced. In the preferred embodiments considered in the following description, it is assumed that ambient components are spatially diffuse, i.e. that their Gerzon energy vector is null. This assumption is not restrictive in practice for simulating room reverberation or surrounding background ambience in the virtual environment.

Additional design criteria for a matrixed surround encoding-decoding scheme according to a preferred embodiment of the present invention arise from technology compatibility requirements: it is desirable that the proposed interactive matrix encoder consistently produce an output suitable for decoding with prior-art matrix surround decoders, which assume specific phase-amplitude relationships between the encoded channel signals $L_T$ and $R_T$ for a sound component panned to one of the five channels ($L_S$, L, C, R, $R_S$), as indicated by equation (1). Conversely, in a preferred embodiment of the present invention, the matrixed surround decoder is compatible with legacy matrix encoded content, i.e. responds to strong directional dominance in its input signal in a manner consistent with the response of a prior-art matrixed surround decoder.

Further, in a preferred embodiment of the present invention, the matrixed surround decoder should produce a natural sounding "upmix" when subjected to any standard stereo source (not necessarily matrix encoded), ideally without need to modify its operation (such as switching from "movie mode" to "music mode", as is common in prior-art matrixed surround decoders). This implies that ambient sound components in the input stereo signal should be extracted and redistributed by the decoder to make use of the surround output channels ($L_S$ and $R_S$) in order to enhance the sense of immersion, while maintaining the original localization of primary sound components in the stereo image and making use of the center loudspeaker to improve the robustness of the sound image against lateral displacements of the listener away from the "sweet spot".

Improved Phase-Amplitude Stereo Encoder

An improved phase-amplitude matrixed surround encoder according to one embodiment of the present invention is elaborated in the following. In a first step, the positional encoding of primary sound components in the 2-D horizontal circle is considered. Then, a 3-D spherical encoding scheme is derived. Lastly, the encoding scheme is completed by including the addition of spatially diffuse ambient sound components in the encoded signal. In a preferred embodiment, spatial cues are provided for each individual sound source by a gaming engine or by a studio mixing application and the encoder operates on a time domain or frequency-domain representation of the source signals. In other embodiments, a multi-channel source signal is provided in a known spatial audio recording format, this signal is converted to or received in a frequency domain representation, and the spatial cues for each time and frequency are derived by spatial analysis of the multi-channel source signal.

2-D Peripheral Encoding

Considering a set of M monophonic sound source signals $\{S_m[t]\}$, a two-channel stereo mixture $\{L_T[t], R_T[t]\}$ of primary sound components can be expressed as:

$$L_T[t]=\Sigma_m L_m S_m[t]$$

$$R_T[t]=\Sigma_m R_m S_m[t] \quad (9.)$$

where $L_m$ and $R_m$ denote the left and right panning coefficients for each source. For a source assigned the panning angle $\alpha$ on the encoding circle (as illustrated in FIG. 2A), the energy-preserving phase-amplitude panning coefficients can be expressed as:

$$L(\alpha)=\cos(\alpha/2+\pi/4)$$

$$R(\alpha)=\sin(\alpha/2+\pi/4) \quad (10.)$$

where the panning angle $\alpha$ is measured clockwise from the front direction (C), and varies from $\alpha=-\pi/2$ (radians) for a signal panned to the left channel to $\alpha=\pi/2$ for a signal panned to the right channel. Assuming that a spans an interval extended to $[-\pi, \pi]$, all positions on the encoding circle of FIG. 2A are uniquely encoded by equations (10), with panning coefficients of opposite polarity for positions in the surround arc (L-$L_S$-$R_S$-R). The application of the phase-amplitude panning equations (10) involves mapping the desired azimuth angle $\theta$, measured on the listening circle shown in FIG. 3, to the panning angle $\alpha$. As indicated in FIG. 2A, this mapping must be such that $\theta=\theta_F$ maps to $\alpha=\pi/2$ and that $\theta=\theta_S$ maps to $\alpha=-\alpha_S$, where $\theta_F$ denotes the azimuth angle assigned to the front channels L or R (for instance 30°), $\theta_S$ denotes the azimuth angle assigned to the surround channels $L_S$ or $R_S$ (for instance 110°), and $\alpha_S$ verifies, for consistency with the multichannel matrix encoding equation (1), $$\sigma_S=|\alpha_S/2+\pi/4|. \quad (11.)$$

For encoding at intermediate positions on the circle, any monotonous mapping from θ to α is in principle appropriate. In order to ensure compatibility with the matrix encoding of 5-channel mixes using equations (1), a suitable θ-to-α angular mapping function is one which is equivalent to 5-channel pairwise amplitude panning, using a well-known prior art panning technique such as the vector-based amplitude panning method (VBAP), followed by 5-to-2 matrix encoding.

However, the 5-to-2 encoding matrix is not actually energy preserving when its inputs are not mutually uncorrelated, as is the case when a source is amplitude panned between channels. For instance, it boosts signal power by $1+\sin(2\sigma_S)$ i.e. approximately 3 dB for a sound panned to rear center, and by $1+\sqrt{1/2}$ or 2.3 dB for a sound panned equally between C and L. In an encoder according to an embodiment of the present invention, such energy deviations are eliminated by scaling each source signal according to its panning position. As a simplification, it is also advantageous to pan over only 4 channels ($L_S$, L, R, $R_S$), ignoring C, before matrix encoding.

2-D Encoding with Interior Panning

An important difference between direct 2-channel encoding using equations (10) and multichannel panning with matrix encoding using equations (1) is that the latter incorporate a 90-degree phase shift applied to the surround channels $L_S$ and $R_S$, which has the effect of distributing the 180-degree phase difference equally between the left and right encoded channels. Without this phase shift, denoted by j in equation (1), a "fly-by" or "fly-over" sound effect panned between front center position and the rear center position would be encoded as panning along the left half of the encoding circle. Denoting ρ(θ) the set of panning weights obtained by peripheral panning (using, for instance, the VBAP technique), the horizontal multichannel panning algorithm can be extended to include interior panning localizations as follows:

$$P(\theta,\psi)=\cos\psi\rho(\theta)+\sin\psi\epsilon \quad (12.)$$

where P is the resulting set of panning weights (prior to scaling for energy preservation), cos ψ and sin ψ are "radial panning" coefficients with ψ within [0, π/2], and ϵ is a set of energy-preserving non-directional (or "middle") panning weights that yields a Gerzon velocity vector of zero magnitude by equations (6, 7). In the case of 4-channel panning over ($L_S$, L, R, $R_S$), the preferred solution for the set of non-directional panning weights ϵ is the one that exhibits left-right symmetry and a front-to-back amplitude panning ratio equal to $|\cos\theta_S/\cos\theta_F|$.

Figure 4A:
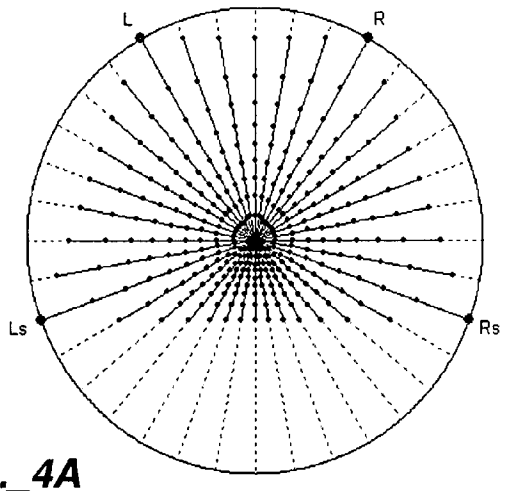
FIG. 4A is a 2-D plot of the Gerzon velocity vector obtained by 4-channel peripheral panning in 10-degree azimuth increments and radial panning in 9 increments, for loudspeakers $L_S$, L, R, and $R_S$ respectively located at azimuth angles −110, −30, 30 and 110 degrees on the listening circle in the horizontal plane.
Figure 4B:
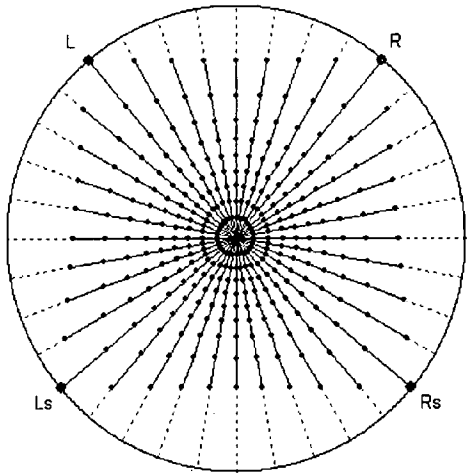
FIG. 4B is a 2-D plot of the Gerzon velocity vector obtained by 4-channel peripheral panning in 10-degree azimuth increments and radial panning in 9 increments, for loudspeakers $L_S$, L, R, and $R_S$ respectively located at azimuth angles −130, −40, 40 and 130 degrees on the listening circle in the horizontal plane.

FIG. 4A shows a plot of the Gerzon velocity vector g derived from P(θ, ψ) by equations (6, 7) when θ and ψ vary in 10-degree increments, with loudspeakers $L_S$, L, R, and $R_S$ respectively located at azimuth angles −110, −30, 30 and 110 degrees on the listening circle in the horizontal plane. The radial panning positions for a given azimuth value are connected by a solid line, which is prolonged by a dotted line connecting to the corresponding point on the edge of the listening circle. Similarly, FIG. 4B illustrates an alternative embodiment of the invention where loudspeakers $L_S$, L, R, and $R_S$ are respectively located at azimuth angles −130, −40, 40 and 130 degrees on the listening circle.

Figure 5A:
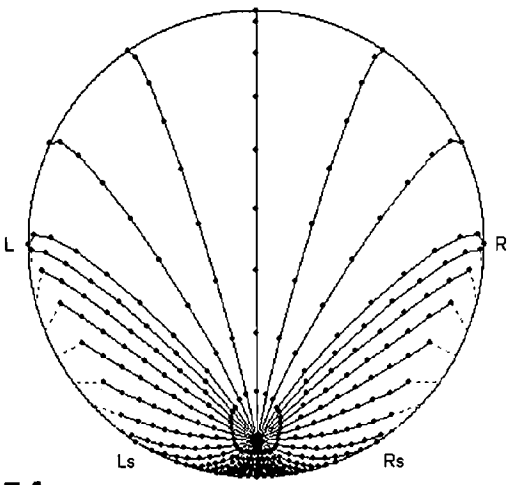
FIG. 5A is a 2-D plot of the dominance vector on the phase-amplitude encoding circle for the panning localizations and loudspeaker positions represented in FIG. 4A, with the surround encoding angle as set to −148 degrees, in accordance with one embodiment of the invention.
Figure 5B:
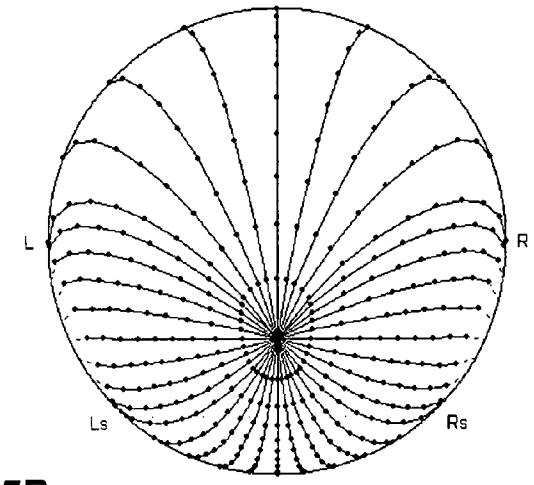
FIG. 5B is a 2-D plot of the dominance vector on the phase-amplitude encoding circle for the panning localizations and loudspeaker positions represented in FIG. 4B, with the surround encoding angle $\alpha_S$ set to −135 degrees, in accordance with another embodiment of the invention.

FIG. 5A plots the dominance vector derived from P(θ, ψ) by using equations (5) after matrix encoding by equations (1), under the same assumptions as in FIG. 4A, assuming that the surround encoding angle $\alpha_S$ is −148 degrees (i.e. $\sigma_S$=29 degrees). The encoding positions for a given azimuth value are connected by a solid line. On the side arcs (L-$L_S$) and (R-$R_S$), this solid line is prolonged by a dotted segment connecting to the corresponding encoding point on the edge of the encoding circle, defined by the peripheral encoding equations (10) and assuming linear mapping from θ to α. Similarly, FIG. 5B plots the dominance vector derived for the alternative embodiment assumed in FIG. 4B, and assuming that the surround encoding angle $\alpha_S$ is −135 degrees (i.e. $\sigma_S$=22.5 degrees).

Since the matrix encoding equations (1) are linear, the application of any 4-channel radial panning technique followed by matrix encoding can also be viewed as a cross-fading operation applied to the phase-amplitude stereo encoding coefficients:

$$L(\alpha,\psi)=\cos\psi L(\alpha)+\sin\psi\epsilon_L$$

$$R(\alpha,\psi)=\cos\psi R(\alpha)+\sin\psi\epsilon_R \quad (13.)$$

where, $\epsilon_L$ and $\epsilon_R$ are derived by matrix encoding from the set of "middle" panning weights ϵ. Because of the 90-degree phase shifts in the matrix encoding equations (1), $\epsilon_L$ and $\epsilon_R$ are conjugate complex coefficients including a phase shift:

$$\epsilon_L=|\cos\theta_S|+j\cos\theta_F(\cos\sigma_S+\sin\sigma_S)$$

$$\epsilon_r=|\cos\theta_S|-j\cos\theta_F(\cos\sigma_S+\sin\sigma_S). \quad (14.)$$

Since the stereo encoding coefficients are generally not real factors, the direct implementation of 2-channel panning for each primary sound source is impractical in the time domain. Preferred time-domain embodiments of the invention use the 4-channel peripheral-radial panning and encoding scheme described above, or may use panning and mixing in the 5-channel format ($L_S$, L, T, R, $R_S$), where T represents a virtual "middle" channel as indicated in FIG. 3, followed by 5-to-2 matrix encoding using the following encoding equations:

$$L_T=L+\epsilon_L T+j(\cos\sigma_S L_S+\sin\sigma_S R_S)$$

$$R_T=R+\epsilon_R T-j(\sin\sigma_S L_S+\cos\sigma_S R_S). \quad (15.)$$

3-D Positional Phase-Amplitude Stereo Encoding

When cos ψ=0 (and therefore sin ψ=1) in equation (12), the notional localization of the sound event coincides with the reference listening position. However, in 4-channel loudspeaker reproduction, a listener located at this position would perceive a sound event localized above the head. This suggests that increasing the value of the radial panning angle ψ from 0 to 90 degrees could be interpreted as increasing the elevation angle ϕ of the virtual source position on the listening sphere from 0 to 90 degrees. This interpretation of radial panning enables establishing an equivalence between 2-D peripheral-radial panning at a localization (θ, r) in the horizontal listening circle of FIG. 3, employing a virtual 'Middle' channel T, and 3-D multi-channel panning at a localization (θ, ϕ) on the upper hemisphere, where T represents a virtual or actual 'Top' channel and ϕ is the 3-D elevation angle, while r denotes the 2-D localization radius.

The choice of mapping functions from the radial panning angle ψ to the radius r and to the elevation angle ϕ is not critical, provided that the mapping functions be monotonous and such that, when ψ increases from 0 to 90 degrees, the radius r decreases from 1 to 0 and the elevation angle ϕ increases from 0 to 90 degrees. The most straightforward assumption, adopted in the following embodiments, is that $r=\cos\psi$ and $\phi=\psi$, which implies that r and $\phi$ are related by vertical projection:

$$r=\cos\phi. \tag{16.}$$

Upon matrix encoding, any source localization on the upper hemisphere or the horizontal circle is thereby encoded by inter-channel amplitude and phase differences in the 2-channel signal $\{L_T, R_T\}$ In order to examine the properties of phase-amplitude stereo encoding systems, it is common to employ a spherical representation of stereo phase-amplitude encoding that extends the panning equations (10) to include arbitrary inter-channel phase differences:

$$L(\alpha,\beta)=\cos(\alpha/2+\pi/4)e^{j\beta/2}$$

$$R(\alpha,\beta)=\sin(\alpha/2+\pi/4)e^{-j\beta/2}. \tag{17.}$$

In graphical representation, as shown in FIG. 2B, the inter-channel phase difference angle $\beta$ is interpreted as a rotation around the left-right axis of the plane in which the amplitude panning angle $\alpha$ is measured. If $\alpha$ spans $[-\pi/2, \pi/2]$ and $\beta$ spans $]-\pi, \pi]$, the angle coordinates $(\alpha, \beta)$ uniquely map any inter-channel phase and/or amplitude difference to a position on the "Scheiber sphere". In particular, $\beta=0$ describes the frontal arc (L-C-R) and $\beta=\pi$ describes the rear arc ($L$-$L_S$-$R_S$-R). By convention, in a preferred embodiment, positive values of $\beta$ will correspond to the upper hemisphere and negative values of $\beta$ to the lower hemisphere. For the "top" position T, equations (14) imply that the inter-channel phase difference in the matrix-encoded stereo signal is:

$$\beta_T=2\arctan[(\cos\sigma_S+\sin\sigma_S)\cos\theta_F/|\cos\theta_S|] \tag{18.}$$

A useful property is that the dominance vector $\delta$ derived by equations (5) coincides with the vertical projection onto the horizontal plane of the position $(\alpha, \beta)$ on the Scheiber sphere:

$$\delta_x=\sin\alpha$$

$$\delta_y=\cos\alpha\cos\beta. \tag{19.}$$

Consequently, a dominance plot such as FIG. 5 is also a "top-down" view of the notional encoding positions on the Scheiber sphere. This allows extending the phase-amplitude 3-D positional encoding scheme to include symmetrical positions in the lower hemisphere, by defining a "bottom" encoding position. In a preferred embodiment, this position, denoted B, is defined as the symmetric of the "top" position T on the Scheiber sphere with respect to the horizontal plane, at $(\alpha, \beta)=(0, -\beta_T)$, so that the upper and lower hemispheres are equivalent for a 2-D matrix decoder.

Figure 6B:
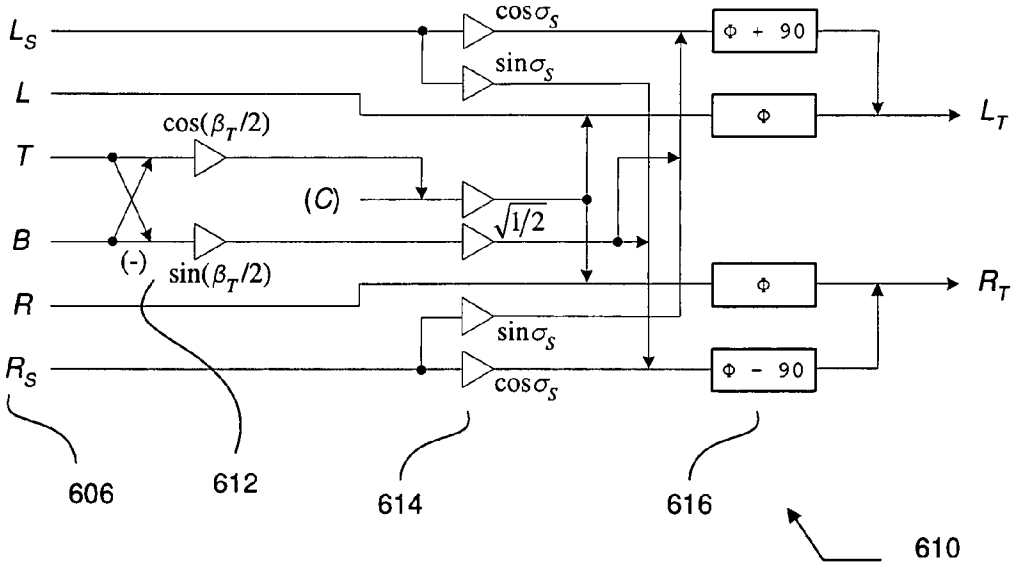
FIG. 6B is a diagram illustrating a multichannel phase-amplitude encoding matrix for converting a 6-channel 3-D audio signal into a two-channel phase-amplitude matrix-encoded 3-D audio signal, in accordance with one embodiment of the invention.
Figure 6A:
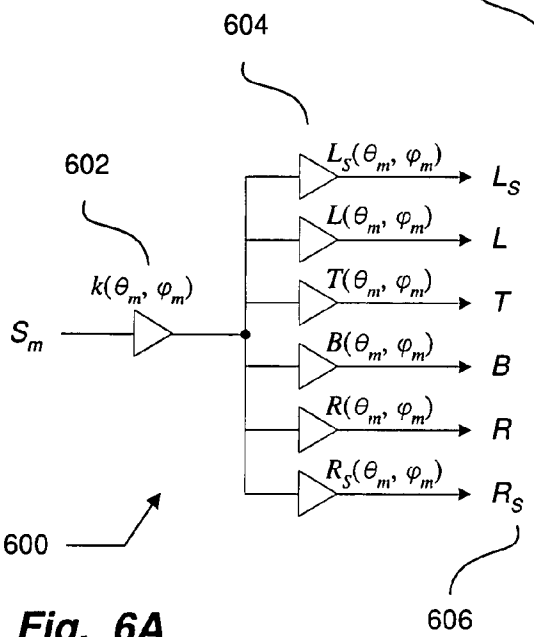
FIG. 6A is a diagram illustrating a 6-channel 3-D positional audio panning module in accordance with one embodiment of the invention.

FIG. 6A and FIG. 6B together depict a 3-D positional phase-amplitude stereo encoding scheme according to a preferred embodiment of the present invention. FIG. 6A depicts a 6-channel panning module (600) for assigning a 3-D positional audio localization $(\theta_m, \phi_m)$ to a primary sound source signal $S_m$ in the 6-channel format ($L_S$, L, T, B, R, $R_S$) where T denotes the Top channel and B denotes the Bottom channel, as described previously. FIG. 6B depicts a phase-amplitude 3-D stereo encoding matrix module (610), where the resulting 6-channel signal (606) is matrix encoded into a two-channel phase-amplitude stereo encoded signal $\{L_T, R_T\}$ according to the following encoding equations:

$$L_T=L+\epsilon_L T+\epsilon_R B+j(\cos\sigma_S L_S+\sin\sigma_S R_S)$$

$$R_T=R+\epsilon_R T+\epsilon_L B-j(\sin\sigma_S L_S+\cos\sigma_S R_S) \tag{20.}$$

where $\epsilon_L=\sqrt{1/2}\exp(j\beta_T/2)$ and $\epsilon_R=\sqrt{1/2}\exp(-j\beta_T/2)$, so that $\epsilon_L^2+\epsilon_R^2=1$.

In the 6-channel 3-D positional panning module depicted in FIG. 6A, the source is scaled by six panning coefficients 604 derived from the azimuth angle $\theta_m$ and the elevation angle $\phi_m$ as follows (omitting the source index m for clarity):

$$L(\theta,\phi)=\cos\phi L(\theta)\ L_S(\theta,\phi)=\cos\phi L_S(\theta)$$

$$R(\theta,\phi)=\cos\phi R(\theta)\ R_S(\theta,\phi)=\cos\phi R_S(\theta)$$

$$T(\theta,\phi)=\sin\phi[\phi>0?]\ B(\theta,\phi)=-\sin\phi[\phi<0?] \tag{21.}$$

where [<condition>?] denotes a logical bit (i.e. 1 if <condition> is true, 0 if it is false). In a preferred embodiment, the coefficients $L_S(\theta)$, $L(\theta)$, $R(\theta)$ and $R_S(\theta)$ in equation (21) are energy-preserving 4-channel 2-D peripheral amplitude panning coefficients derived from the azimuth angle $\theta$ using the VBAP method, according to the front and surround loudspeaker azimuth angles respectively denoted as $\theta_F$ and $\theta_S$ and assigned respectively to the front channel pair (L, R) and to the surround channel pair ($L_S$, $R_S$). Further, in a preferred embodiment of the present invention, the source signal feeding each panning module is scaled by an energy normalization factor 602, equal to:

$$k(\theta,\varphi)=\frac{1}{\sqrt{L_T(\theta,\varphi)^2+R_T(\theta,\varphi)^2}}. \tag{22}$$

where $L_T(\theta, \phi)$ and $R_T(\theta, \phi)$ are derived by applying the encoding matrix defined by equations (20) to the panning coefficients defined by equations (21). This normalization ensures that the contribution of each source signal $S_m$ in the matrix-encoded signal $\{L_T, R_T\}$ is energy-preserving, regardless of its panning localization $(\theta_m, \phi_m)$.

The particular embodiment of the encoding matrix 610 in FIG. 6B is obtained by rewriting equation (20) as follows:

$$L_T=L+\sqrt{1/2}(T+B)\cos(\beta_T/2)+j[(T-B)\sin(\beta_T/2)+\cos\sigma_S L_S+\sin\sigma_S R_S]$$

$$R_T=R+\sqrt{1/2}(T+B)\cos(\beta_T/2)-j[(T-B)\sin(\beta_T/2)+\sin\sigma_S L_S+\cos\sigma_S R_S]. \tag{23.}$$

The resulting encoding matrix is an extension of the prior-art encoding matrix depicted in FIG. 1C, where the input C is optional. The encoding matrix receives 6 input channels 606 produced by the panning module 600. The input channels $L_S$, L, R and $R_S$ are processed exactly as in the legacy encoding matrix shown in FIG. 1, using multipliers 614 and all-pass filters 616. The encoding matrix also receives two additional channels T and B, derives their sum and difference signals, and applies to the sum and difference signals the scaling coefficients 612, respectively $\cos(\beta_T/2)$ and $\sin(\beta_T/2)$. The scaled sum and difference signals and then further attenuated by a coefficient $\sqrt{1/2}$ before being combined, respectively, with the front channel and the scaled surround input channels. Alternative embodiments of the phase-amplitude matrixed surround encoding scheme according to the present invention may be realized, within the scope of the present invention, by selecting an arbitrary value within $[0, \pi]$ for $\beta_T$, instead of the value derived by equation (18).

Mapping the Listening Sphere to the Scheiber Sphere

The combined effect of the 3-D positional panning module 600 and of the 3-D stereo encoding matrix 610 is to map the due localization $(\theta, \phi)$ on the listening sphere to a notional position $(\alpha, \beta)$ on the Scheiber sphere. This mapping can be configured by setting the values of the angular parameters defined previously: $\theta_F$ within $[0, \pi/2]$; $\theta_S$ within $[\pi/2, \pi]$; $\sigma_S$ within $[0, \pi/4]$; and $\beta_T$ within $[0, \pi]$. Two examples of such mapping are illustrated in FIGS. 5A and 5B. The setting of these parameters determines the compatibility of the encoding-decoding scheme according to the invention with legacy matrixed surround decoders and matrix-encoded content. For instance, a legacy-compatible encoder can be realized by setting $\theta_F$=30°, $\theta_S$=110°, $\sigma_S$=29°, and deriving $\beta_T$ according to equation (18). The range of possible encoding schemes can be further extended by introducing a front encoding angle parameter $\sigma_F$ within [0, π/4], and replacing L and R respectively by (cos $\sigma_F$ L+sin $\sigma_F$ R) and (cos $\sigma_F$ R+sin $\sigma_F$ L) prior to applying equation (20) or (23). In a legacy-compatible embodiment of the encoding matrix, $\sigma_F$=0 and the channels L and R are passed unmodified to the encoded channels $L_T$ and $R_T$, respectively.

Further, it is straightforward to extend the preferred embodiment described above, within the scope of the invention, to use any intermediate P-channel format ($C_1$, $C_2$, . . . $C_p$ . . . ) instead of the preferred 6-channel format ($L_S$, L, T, B, R, $R_S$), associated to additional or alternative intermediate channel positions $\{(\theta_p, \phi_p)\}$ in the horizontal plane or anywhere on the listening sphere, using any 2-D or 3-D multichannel panning technique to implement the multichannel positional panning module for each sound source signal $S_m$, and matrix-encoding each intermediate channel $C_p$ as a 3-D source with localization $(\theta_p, \phi_p)$ according to the panning and encoding scheme defined by equations (21, 23) or (21, 20).

Alternatively, in another embodiment of the invention, the localization of a sound source on the listening sphere is expressed according to the Duda-Algazi angular coordinate system, where the azimuth angle μ is measured in a plane containing the source and the left-right ear axis, and the elevation angle ν measures the rotation of this plane with respect to the left-right ear axis. In this case the localization coordinates μ and ν can be mapped separately to the amplitude panning angle α and the inter-channel phase difference angle β. One embodiment consists of setting α=μ and β=ν, in which case the listening sphere maps identically to the Scheiber sphere, and phase-amplitude 3-D stereo encoding is achieved directly by applying equations (17).

It will be readily apparent that, regardless of the chosen mapping from localization to encoding position on the Scheiber sphere, the phase-amplitude stereo encoding of the signals according to the invention can be realized in the frequency domain by applying encoding coefficients $L(\alpha_m, \beta_m)$ and $L(\alpha_m, \beta_m)$ to a frequency-domain representation of the sound source signal $S_m$.

Ambience Encoding

In a preferred embodiment of the invention, the interactive phase-amplitude stereo encoder includes means for incorporating spatially diffuse ambience and reverberation components in the 2-channel encoded output signal $\{L_T, R_T\}$.

Let us assume that the spatial audio scene contains only ambient components. In prior-art matrixed surround decoders, this condition is associated with zero dominance, and occurs when the signals $L_T$ and $R_T$ are uncorrelated and of equal energy (which is consistent with the signal properties of ambient components in conventional stereo recordings). In these conditions, a prior-art multichannel matrixed surround decoder falls into its passive decoding behavior, which has the effect of spreading signal energy into the surround channels. This is a desirable property both for matrixed surround decoders and for music upmixers.

However, a drawback of any matrixed surround encoding-decoding system using a prior-art time-domain matrix encoder complying with equation (1) is that the spatial distribution of an ambient sound scene reproduced by the decoder is not consistent with the original recording: it exhibits a significant systematic bias toward the rear channels $L_S$ and $R_S$. An analogous phenomenon is visible in FIGS. 5A and 5B for primary signals, where it is seen that a multichannel signal having a null Gerzon velocity vector is encoded with strong negative dominance, indicating strong negative correlation between the left and right encoded signals $L_T$ and $R_T$. In the case of a diffuse ambient signal (with a null energy vector), the front-to-back channel power ratio would be equal to $|\cos\theta_S|/\cos\theta_F$, which by equation (5) sets the dominance at −0.434 on the y axis if $\theta_F$=30° and $\theta_S$=110°, causing a matrixed surround decoder to pan signal energy heavily into the surround channels (instead of falling into its passive behavior). In a preferred embodiment of a phase-amplitude stereo encoder according to the present invention, this bias is avoided by mixing the ambient components directly into the two-channel output $\{L_T, R_T\}$ of the phase-amplitude encoder or into the input channels L and R of the encoding matrix 610 (whereas, in a prior-art encoding scheme, a significant amount of ambient signal energy would be mixed into the surround input channels of the encoding matrix).

Figure 6C:
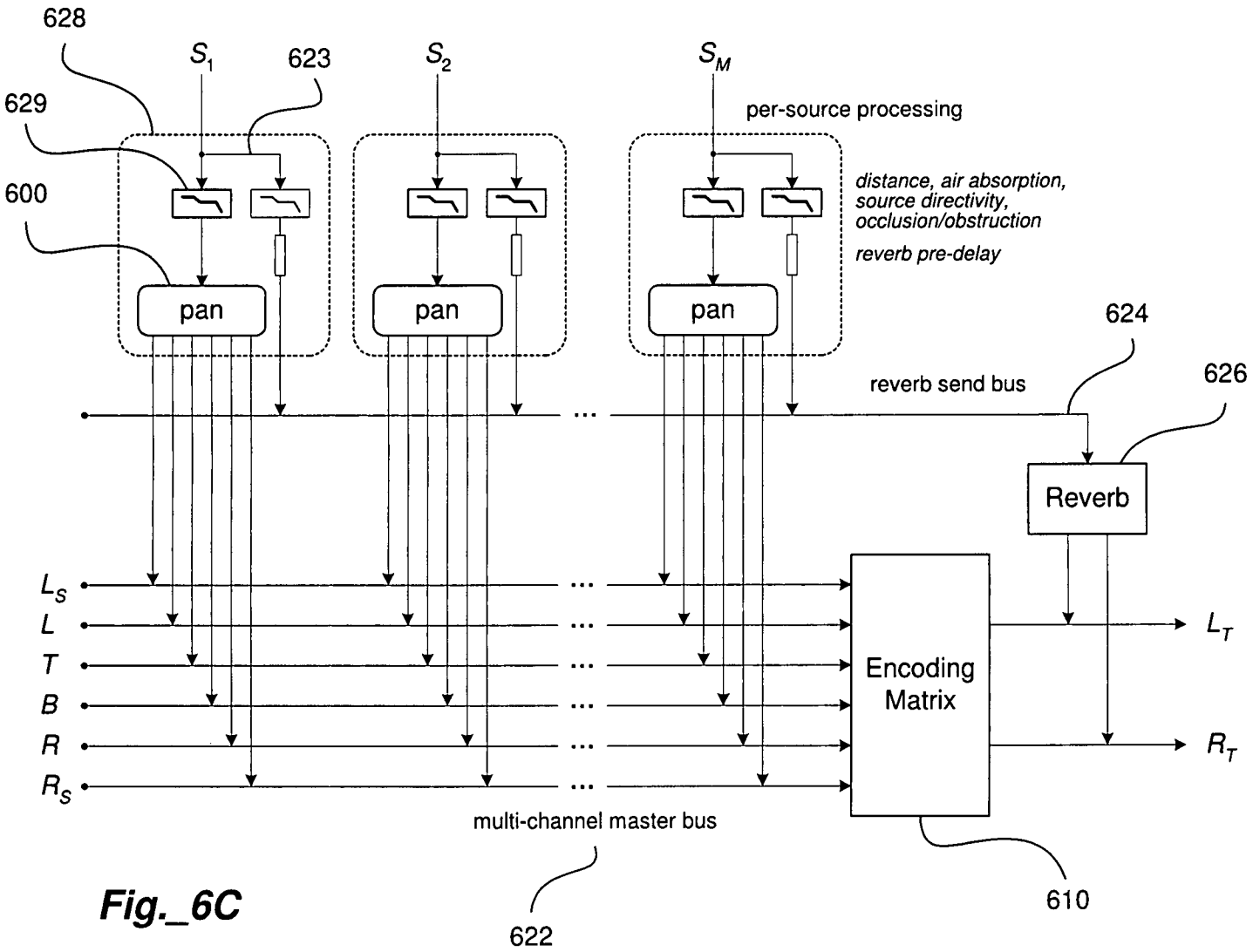
FIG. 6C depicts a complete interactive phase-amplitude 3-D stereo encoder, in accordance with one embodiment of the invention.

FIG. 6C depicts an interactive phase-amplitude 3-D stereo encoder, according to a preferred embodiment of the invention. Each source $S_m$ generates a primary sound component panned by a panning module 600 described previously and depicted in FIG. 6A, which assigns the localization $(\theta_m, \phi_m)$ to the source signal. The output of each panning module 600 is added into the master multichannel bus 622 which feeds the encoding matrix 610 described previously and illustrated in FIG. 6B. Additionally, each source signal $S_m$ generates a contribution 623 to the reverb send bus 624, which feeds a reverberation module 626, thereby producing the ambient sound component associated to the source signal $S_m$. The reverberation module 626 simulates the reverberation of a virtual room and generates two substantially uncorrelated reverberation signals by methods well known in the prior art, such as feedback delay networks. The two output signals of the reverberation module 626 are combined directly into the output $\{L_T, R_T\}$ of the encoding matrix 610. The per-source processing module 623 that generates the primary sound component and the ambient sound component for each source signal $S_m$ may include filtering and delaying modules 629 to simulate distance, air absorption, source directivity, or acoustic occlusion and obstruction effects caused by acoustic obstacles in the virtual scene, using methods known in the prior art.

Improved Phase-Amplitude Matrixed Surround Decoder

In accordance with one embodiment of the invention, provided is a frequency domain method for phase-amplitude matrixed surround decoding of 2-channel stereo signals such as music recordings and movie or video game soundtracks, based on spatial analysis of 2-D or 3-D directional cues in the input signal and re-synthesis of these cues for reproduction on any headphone or loudspeaker playback system, using any chosen sound spatialization technique. As will be apparent in the following description, this invention enables the decoding of 3-D localization cues from two-channel audio recordings while preserving backward compatibility with prior-art two-channel horizontal-only phase-amplitude matrixed surround encoding-decoding techniques such as described previously.

The present invention uses a time/frequency analysis and synthesis framework to significantly improve the source separation performance of the matrixed surround decoder. The fundamental advantage of performing the analysis as a function of both time and frequency is that it significantly reduces the likelihood of concurrence or overlap of multiple sources in the signal representation, and thereby improves source separation. If the frequency resolution of the analysis is comparable to that of the human auditory system, the possible effects of any overlap of concurrent sources in the frequency-domain representation is substantially masked during reproduction of the decoder's output signal over headphones or loudspeakers.

By operating on frequency-domain signals and incorporating primary-ambient decomposition, a matrixed surround decoder according to the invention overcomes the limitations of prior-art matrix surround decoders in terms of diffuse ambience reproduction and directional source separation, and is able to analyze dominance information for primary sound components while avoiding confusion by the presence of ambient components in the scene, in order to accurately reproduce 2-D or 3-D positional cues via any spatial reproduction system. This enables a significant improvement in the spatial reproduction of two-channel matrix-encoded movie and game soundtracks or conventional stereo music recordings over headphones or loudspeakers.

Figure 7A:
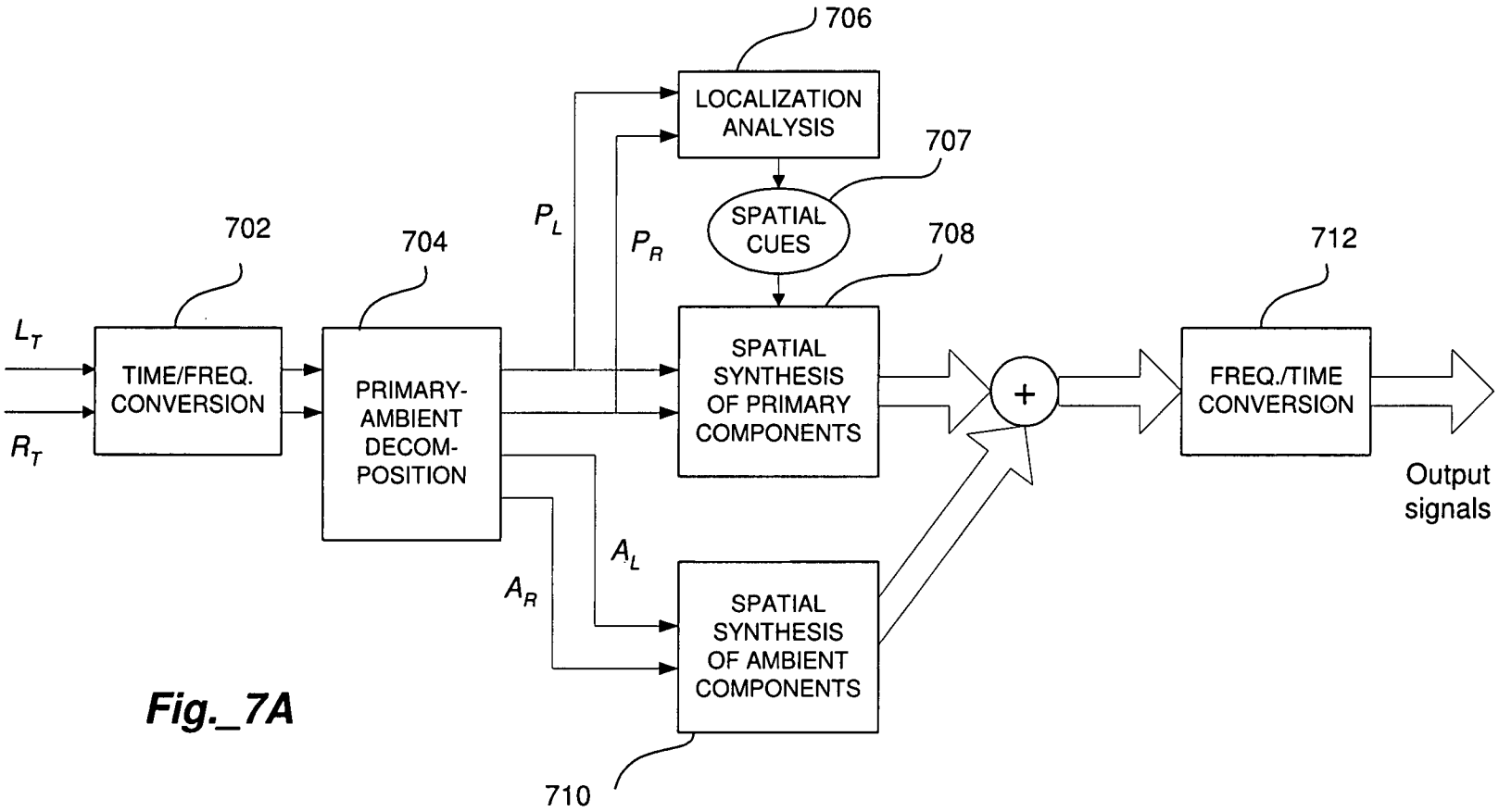
FIG. 7A is a signal flow diagram illustrating a phase-amplitude matrixed surround decoder in accordance with one embodiment of the present invention.

FIG. 7A is a signal flow diagram illustrating a phase-amplitude matrixed surround decoder in accordance with one embodiment of the present invention. Initially, a time/frequency conversion takes place in block 702 according to any conventional method known to those of skill in the relevant arts, including but not limited to the use of a short term Fourier transform (STFT) or any subband signal representation.

Next, in block 704, a primary-ambient decomposition occurs. This decomposition is advantageous because primary signal components (typically direct-path sounds) and ambient components (such as reverberation or applause) generally require different spatial synthesis strategies. The primary-ambient decomposition separates the two-channel input signal $S_T=\{L_T, R_T\}$ into a primary signal $S_P\{P_L, P_R\}$ whose channels are mutually correlated and an ambient signal $S_A=\{A_L, A_R\}$ whose channels are mutually uncorrelated or weekly correlated, such that a combination of signals $S_P$ and $S_A$ reconstructs an approximation of signal $S_T$ and the contribution of ambient components existing in signal $S_T$ are significantly reduced in the primary signal $S_P$. Frequency-domain methods for primary-ambient decomposition are described in the prior art, for instance by Merimaa et al. in "Correlation-Based Ambience Extraction from Stereo Recordings", presented at the 123$^{rd}$ Convention of the Audio Engineering Society (October 2007).

The primary signal $S_P=\{P_L, P_R\}$ is then subjected to a localization analysis in block 706. For each time and frequency, the spatial analysis derives a spatial localization vector d representative of a physical position relative to the listener's head. This localization vector may be three-dimensional or two-dimensional, depending of the desired mode of reproduction of the decoder's output signal. In the three-dimensional case, the localization vector represents a position on a listening sphere centered on the listener's head, characterized by an azimuth angle θ and an elevation angle ϕ. In the two-dimensional case, the localization vector may be taken to represent a position on or within a circle centered on the listener's head in the horizontal plane, characterized by an azimuth angle θ and a radius r. This two-dimensional representation enables, for instance, the parametrization of fly-by and fly-through sound trajectories in a horizontal multichannel playback system.

In the localization analysis block 706, the spatial localization vector d is derived, for each time and frequency, from the inter-channel amplitude and phase differences present in the signal $S_P$. These inter-channel differences can be uniquely represented by a notional position (α, β) on the Scheiber sphere as illustrated in FIG. 2B, according to Eq. (17), where α denotes the amplitude panning angle and β denotes the inter-channel phase difference. According to equation (10) or (17), the panning angle α is related to the inter-channel level difference $m=|P_L|/|P_R|$ by $$\alpha=2\tan^{-1}(1/m)-\pi/2 \tag{24.}$$

According to one embodiment on the invention, the operation of the localization analysis block 706 consists of computing the inter-channel amplitude and phase differences, followed by mapping from the notional position (α, β) on the Scheiber sphere to the direction (θ, ϕ) in the three-dimensional physical space or to the position (θ, r) in the two-dimensional physical space. In general, this mapping may be defined in an arbitrary manner and may even depend on frequency.

According to another embodiment of the invention, the primary signal $S_P$ is modeled as a mixture of elementary monophonic source signals $S_m$ according to the matrix encoding equations (9, 10) or (9, 17), where the notional encoding position $(\alpha_m, \beta_m)$ of each source is defined by a known bijective mapping from a two-dimensional or three-dimensional localization in a physical or virtual spatial sound scene. Such a mixture may be realized, for instance, by an audio mixing workstation or by an interactive audio rendering system such as found in video gaming systems and depicted in FIG. 1A or FIG. 6C. In such applications, it is advantageous to implement the localization analysis block 706 such that the derived localization vector is obtained by inversion of the mapping realized by the matrix encoding scheme, so that playback of the decoder's output signal faithfully reproduces the original spatial sound scene.

In another embodiment of the present invention, the localization analysis 706 is performed, at each time and frequency, by computing the dominance vector according to equations (5) and applying a mapping from the dominance vector position in the encoding circle to a physical position (θ, r) in the horizontal listening circle, as illustrated in FIG. 2A and exemplified in FIG. 5A or 5B. Alternatively, the dominance vector position may then be mapped to a three-dimensional localization (θ, ϕ) by vertical projection from the listening circle to the listening sphere as follows:

$$\phi=\cos^{-1}(r)\mathrm{sign}(\beta) \tag{25.}$$

where the sign of the inter-channel difference β is used to differentiate the upper hemisphere from the lower hemisphere.

Block 708 realizes, in the frequency domain, the spatial synthesis of the primary components in the decoder output signal by applying to the primary signal $S_P$ the spatial cues 707 derived by the localization analysis 706. A variety of approaches may be used for the spatial synthesis (or "spatialization") of the primary components from a monophonic signal, including ambisonic or binaural techniques as well as conventional amplitude panning methods. In one embodiment of the present invention, a mono primary signal P to be spatialized is derived, at each time and frequency, by a conventional mono downmix where $P=\sqrt{1/2}(P_L+P_R)$. In another embodiment, the computation of the mono signal P uses downmix coefficients that depend on time and frequency by application of the passive decoding equation for the notional position (α, β) derived from the inter-channel amplitude and phase differences computed in the localization analysis block 706:

$$P=L^*(\alpha,\beta)P_L+R^*(\alpha,\beta)P_R \tag{26.}$$

where $L^*(\alpha, \beta)$ and $R^*(\alpha, \beta)$ respectively denote the complex conjugates of the left and right encoding coefficients expressed by equations (17):

$$L^*(\alpha,\beta)=\cos(\alpha/2+\pi/4)e^{-j\beta/2}$$

$$R^*(\alpha,\beta)=\sin(\alpha/2+\pi/4)e^{j\beta/2}. \tag{27.}$$

In general, the spatialization method used in the primary component synthesis block 708 should seek to maximize the discreteness of the perceived localization of spatialized sound sources. For ambient components, on the other hand, the spatial synthesis method, implemented in block 710, should seek to reproduce (or even enhance) the spatial spread or diffuseness of sound components. As illustrated in FIG. 7A, the ambient output signals generated in block 710 are added to the primary output signals generated in block 708. Finally, a frequency/time conversion takes place in block 712, such as through the use of an inverse STFT, in order to produce the decoder's output signal.

In an alternative embodiment of the present invention, the primary-ambient decomposition 704 and the spatial synthesis of ambient components 710 are omitted. In this case, the localization analysis 706 is applied directly to the input signal $\{L_T, R_T\}$.

In yet another embodiment of the present invention, the time-frequency conversions blocks 702 and 712 and the ambient processing blocks 704 and 710 are omitted. Despite these simplifications, a matrixed surround decoder according to the present invention can offer significant improvements over prior art matrixed surround decoders, notably by enabling arbitrary 2-D or 3-D spatial mapping between the matrix-encoded signal representation and the reproduced sound scene.

Spatial Analysis

The spatial analysis of the primary signal $S_P=\{P_L, P_R\}$ produces, at each time and frequency, a format-independent spatial localization vector d, characterized by an azimuth angle θ and an elevation angle ϕ or a radius r, to be used in the spatial synthesis of primary signal components, according to any chosen multi-channel audio output format or spatial reproduction technique.

In one embodiment, it is assumed that the input signal $S_T=\{L_T, R_T\}$ was encoded according to the phase-amplitude 3-D positional encoding method defined previously by equations (20, 21) or (21, 23) and illustrated in FIGS. 6A and 6B, with the values of the encoder parameters $\theta_F$, $\theta_S$, $\sigma_S$ and $\beta_T$ known a priori. This defines a unique mapping from the due localization d, characterized by (θ, ϕ) or (θ, r), to the dominance δ, characterized by (α, β) as illustrated by FIG. 5A or FIG. 5B. By application of the corresponding inverse mapping, the spatial analysis can recover, at each time and frequency, the localization d from the dominance δ computed by equations (5).

In a preferred embodiment, this inverse mapping operation is realized by a table-lookup method that returns the values of the azimuth angle θ and of the radius r given the coordinates $\delta_x$ and $\delta_y$ of the dominance vector δ. The lookup tables are generated as follows:

(a) For a high-density sampling of all possible localization values (θ, ϕ), with θ uniformly sampled within [0, 2π] and ϕ uniformly sampled within [0, π], calculate the left and right encoding coefficients $L_T(\theta, \phi)$ and $R_T(\theta, \phi)$ by applying equations (20, 21) or (21, 23) and derive the coordinates $\delta_x(\theta, \phi)$ and $\delta_y(\theta, \phi)$ of the dominance vector from $L_T(\theta, \phi)$ and $R_T(\theta, \phi)$ by applying equations (5).

(b) Define a sampling of the dominance positions in the encoding circle according to the modified dominance coordinate system (θ', r') centered on the 'Top' encoding position T (the dominance position that is reached when ϕ=0 for any value of θ), such that, for r' incrementing uniformly from 0 to 1, the dominance position increments linearly on a straight segment from the point T to a point on the edge of the encoding circle defined by the peripheral encoding equations (10) with θ' as the azimuth angle. Form a first two-dimensional lookup table that returns the nearest sampled position (θ', r') for uniformly sampled values of $\delta_x$ and $\delta_y$.

(c) For each of the sampled dominance positions (θ', r'), record the localization value (θ, ϕ) corresponding to the nearest of the dominance positions obtained in step (b). For positions (θ', r') that fall beyond the side vertices ($L$-$L_S$) and ($R$-$R_S$), record ϕ=0 and determine θ by selecting the nearest of the extension segments that connect each radial panning locus to its corresponding peripheral encoding position on the edge of the circle (dotted segments on FIG. 5A or 5B). Form a second two-dimensional lookup table that returns (θ, ϕ) for each of the sampled dominance positions (θ', r'), with θ' uniformly sampled within [0, 2π] and r' uniformly sampled within [0, 1].

In the preferred embodiment, the inverse mapping operation for the spatial analysis of the localization (θ, ϕ) from the dominance ($\delta_x$, $\delta_y$) is performed in two steps, using the first table to derive (θ', r') and then the second table to obtain (θ, ϕ). The advantage of this two-step process is that it ensures high accuracy in the estimation of the localization coordinates θ and ϕ without employing extremely large lookup tables, despite the fact that the mapping function is heavily non uniform and very "steep" in some regions of the encoding circle (as is visible in FIG. 5A or FIG. 5B).

In an embodiment of the spatial analysis for a 2-D matrixed stereo decoder, the 2-D localization (θ, r) is derived from (θ, ϕ) by taking r=cos ϕ. In a preferred embodiment of the spatial analysis for a 3-D phase-amplitude stereo decoder, the sign of the inter-channel phase difference β, denoted sign(β), is computed in order to select the upper or lower hemisphere, and replace ϕ by its opposite if β is negative. The sign of β may be computed from the complex values of the signals $P_L$ and $P_R$ at each time and frequency, without explicitly computing their phase difference β:

$$\text{sign}(\beta)=\text{sign}(Im(P_L P_R^*)) \tag{28.}$$

where sign(.) is −1 for a strictly negative value and 1 otherwise, Im(.) denotes the imaginary part, and * denotes complex conjugation.

Spatial Synthesis

Figure 7B:
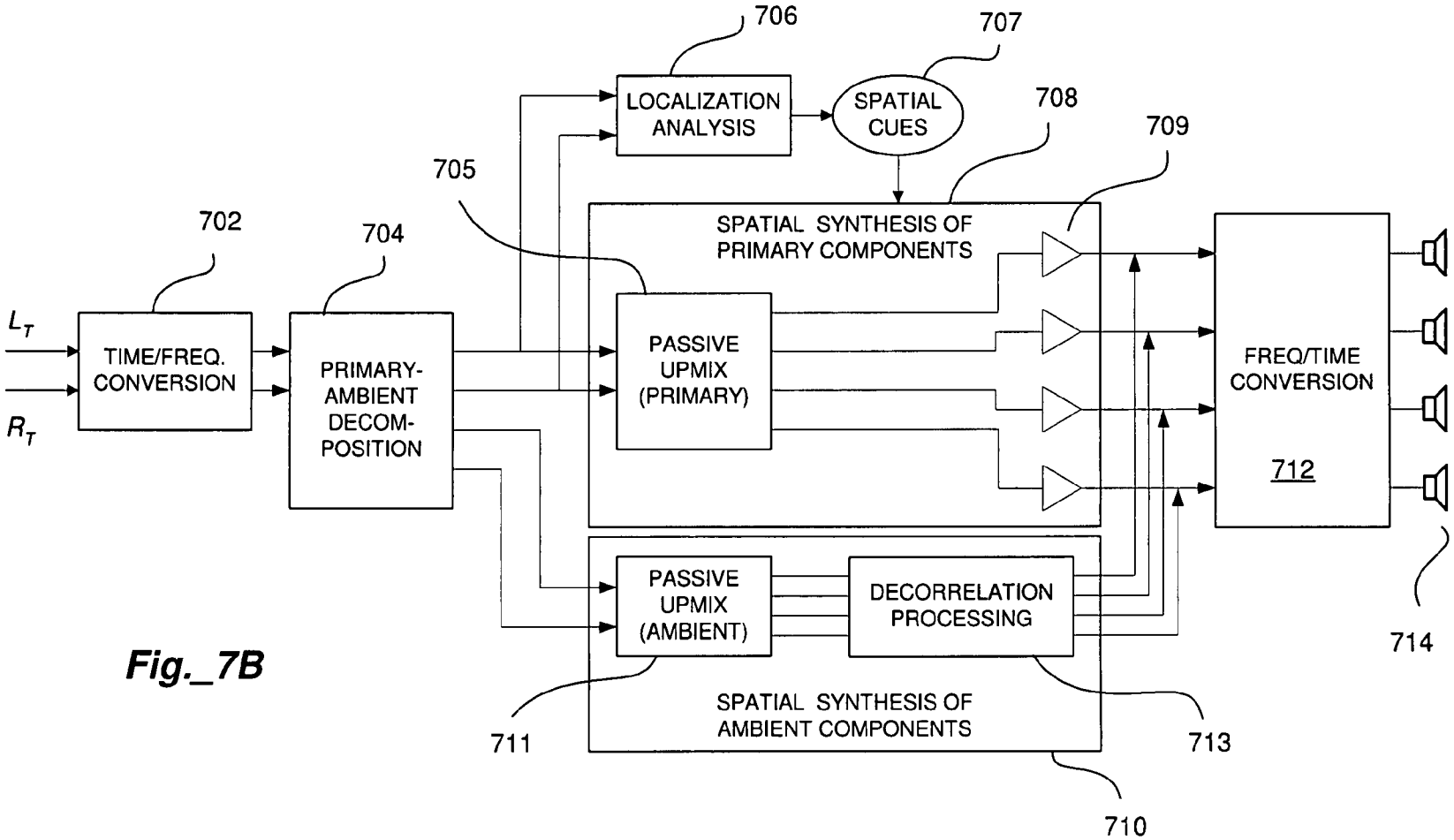
FIG. 7B is a signal flow diagram illustrating a phase-amplitude matrixed surround decoder for multichannel loudspeaker reproduction, in accordance with one embodiment of the present invention.

FIG. 7B is a signal flow diagram depicting a phase-amplitude matrixed surround decoder for multichannel loudspeaker reproduction, in accordance with one embodiment of the present invention. The time/frequency conversion in block 702, primary-ambient decomposition in block 704 and localization analysis in block 706 are performed as described earlier. Given the time- and frequency-dependent spatial localization cues in block 707, the spatial synthesis of primary components in block 708 renders the primary signal $S_P=\{P_L, P_R\}$ to N output channels where N corresponds to the number of transducers in block 714. In the embodiment of FIG. 7B, N=4, but the synthesis is applicable to any number of output channels. Furthermore, the spatial synthesis of ambient components in block 710 renders the ambient signal $S_A=\{A_L, A_R\}$ to the same N output channels.

In one embodiment of block 705, the primary passive upmix forms a mono downmix of its input signal $S_P=\{P_L, P_R\}$ and populates each of its output channels with this downmix. In one embodiment, the mono primary downmix signal, denoted as P, is derived by applying the passive decoding equation (26) for the time- and frequency-dependent encoding position (α, β) on the Scheiber sphere determined by the computed dominance vector δ and sign(β) in the spatial analysis block 706. The spatial synthesis then consists of re-weighting the output channels of block 705 in block 709, at each time and frequency with gain factors computed based on the spatial cues 707, that is d=(θ, r) or d=(θ, ϕ).

Using an intermediate mono downmix when upmixing a two-channel signal can lead to undesired spatial "leakage" or cross-talk: signal components presented exclusively in the left input channel $P_L$ may contribute to output channels on the right side as a result of spatial ambiguities due to frequency-domain overlap of concurrent sources. Although such overlap can be minimized by appropriate choice of the frequency-domain representation, it is preferable to minimize its potential impact on the reproduced scene by populating the output channels with a set of signals that preserves the spatial separation already provided in the decoder's input signal. In another embodiment of block 705, the primary passive upmix performs a passive matrix decoding into the N output signals according to equation (4) as $$P_n = L^*(\alpha_n, \beta_n)P_L + R^*(\alpha_n, \beta_n)P_R \text{ for } n=1 \ldots N \quad (29.)$$

where $(\alpha_n, \beta_n)$ corresponds to the notional position of output channel n on the Scheiber sphere. The resulting N signals are then re-weighted in block 709 with gain factors computed based on the spatial cues 707. In one embodiment of block 709, the gain factors for each channel are determined by deriving multichannel panning coefficients at each time and frequency based on the localization vector d and on the output format, which may be provided by user input or determined by automated estimation.

In the case where the decoder's input signal $S_T=\{L_T, R_T\}$ is a matrix-encoded signal generated according to an embodiment of invention, and the decoder's output format exactly corresponds to the 4-channel layout ($L_S$, L, R, $R_S$) characterized by the front-channel azimuth angle $\theta_F$ and the surround-channel azimuth angle $\theta_S$, then an embodiment of the spatial synthesis block 708 generating a mono downmix signal in block 705 according to equations (26, 27), and panning this downmix signal over the output channels ($L_S$, L, R, $R_S$) in block 709 according to the 2-D peripheral-radial panning method described previously can reconstruct the original set of primary signal components $\{L_S, L, R, R_S\}$ as if no intermediate matrix encoding-decoding had taken place (assuming that the primary-ambient decomposition 704 has successfully extracted all ambient signal components from the signal $S_P=\{P_L, P_R\}$ and assuming that concurrent sound sources are perfectly separated in the chosen time-frequency signal representation).

Similarly, an embodiment of the frequency-domain spatial synthesis block 708 according to the invention may be realized using any sound spatialization or positional audio rendering technique whereby a mono signal is assigned a 3-D localization (θ, ϕ) on the listening sphere or a 2-D localization (θ, r) on the listening circle, for spatial reproduction over loudspeakers or headphones. Such spatialization techniques include, and are not limited to, amplitude panning techniques (such as VBAP), binaural techniques, ambisonic techniques, and wave-field synthesis techniques. Methods for frequency-domain spatial synthesis using amplitude panning techniques are described in more detail in U.S. patent application Ser. No. 11/750,300, entitled Spatial Audio Coding Based on Universal Spatial Cues. Methods for frequency-domain spatial synthesis using binaural, ambisonic, wave-field synthesis or other spatialization techniques based on inter-channel amplitude and phase differences are described further in U.S. patent application Ser. No. 12/243,963, entitled "Spatial Audio Analysis and Synthesis for Binaural Reproduction and Format Conversion", filed Oct. 1, 2008 and incorporated by reference Block 713 in FIG. 7B illustrates one embodiment of the spatial synthesis of ambient components. In general, the spatial synthesis of ambience should seek to reproduce (or even enhance) the spatial spread or diffuseness of the corresponding sound components. In block 713, the ambient passive upmix first distributes the ambient signals $\{A_L, A_R\}$ to each output signal of the block, based on the given output format. In one embodiment, the left-right separation is maintained for pairs of output channels that are symmetric in the left-right direction. That is, $A_L$ is distributed to the left and $A_R$ to the right channel of such a pair. For non-symmetric channel configurations, passive upmix coefficients for the signals $\{A_L, A_R\}$ may be obtained by passive upmix using equations (29) applied to $\{A_L, A_R\}$ instead of $\{P_L, P_R\}$. Each channel is then weighted so that the total energy of the output signals matches that of the input signals, and so that the resulting Gerzon energy vector, computed according to equations (6) and (8), be of zero magnitude. The weighting coefficients can be computed once based on the output format alone, by assuming that $A_L$ and $A_R$ have the same energy and applying methods specified in the U.S. patent application Ser. No. 11/750,300 entitled Spatial Audio Coding Based on Universal Spatial Cues, incorporated herein by reference.

A perceptually accurate multi-channel spatial reproduction of the ambient components over loudspeakers requires that the ambient output signals be mutually uncorrelated. This may be achieved by applying all-pass (or substantially all-pass) "decorrelation filters" (or "decorrelators") to at least some of the ambient output channel signals before combination with the primary output channel signals. In one embodiment of the spatial synthesis of ambient components in block 710 of FIG. 7B, the passively upmixed ambient signals are decorrelated in block 713. In one embodiment of block 713, depending on the operation of the passive upmix block 711, all-pass filters are applied to a subset of the ambient channels such that all output channels of block 713 are mutually uncorrelated. Any other decorrelation method known to those of skill in the relevant arts is similarly viable, and the decorrelation processing may also include delay elements.

Finally, the primary and ambient signals corresponding to each of the N output channels are summed and converted to the time domain in block 712. The time-domain signals are then directed to the N transducers 714.

The matrixed surround decoding methods described result in a significant improvement in the spatial quality of reproduction of 2-channel Dolby-Surround movie soundtracks over headphones or loudspeakers. Indeed, this invention enables a listening experience that is a close approximation of that provided by direct discrete multichannel reproduction or by discrete multi-channel encoding-decoding technology such as Dolby Digital or DTS. Furthermore, the decoding methods described enable faithful reproduction of the original spatial sound scene not only over the originally assumed target multi-channel loudspeaker layout, but also over headphones or loudspeakers with full flexibility in the number of output channels, their layout, and the spatial rendering technique.

Improved Multi-Channel Matrixed Surround Encoder

Figure 8:
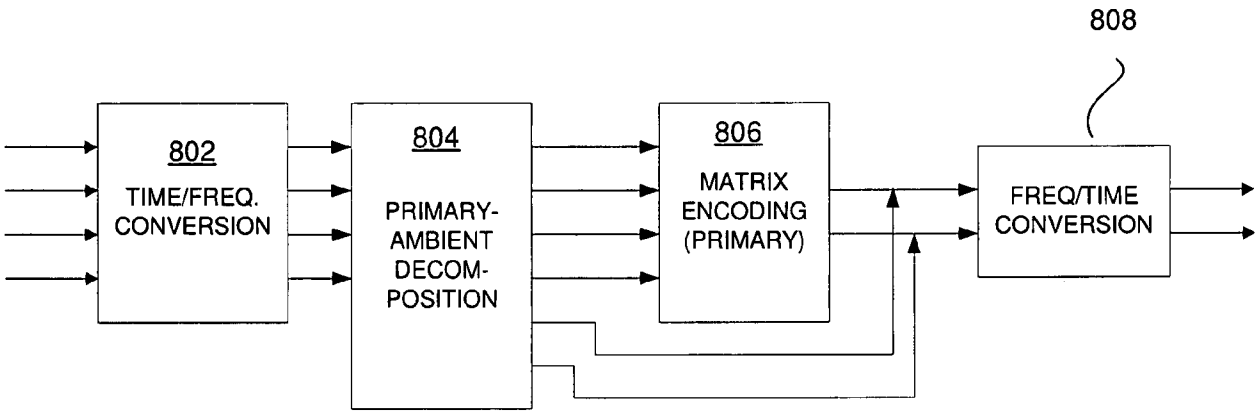
FIG. 8 is a signal flow diagram illustrating a phase-amplitude stereo encoder in accordance with one embodiment of the present invention.

FIG. 8 is a signal flow diagram illustrating a phase-amplitude stereo encoder in accordance with one embodiment of the present invention, where a multi-channel source signal is provided in a known spatial audio recording format. Initially, a time/frequency conversion takes place in block 802. For example, the frequency domain representation may be generated using an STFT. Next, in block 804, primary ambient decomposition takes place, according to any known or conventional methods. Matrix encoding of the primary components of the signal occurs in block 806, followed by the addition of the ambient signals. Finally, in block 808, a frequency/time conversion takes place, such as through the use of an inverse STFT. This method ensures that ambient signal components are encoded in the form of an uncorrelated signal pair, which ensures that a matrix decoder will render them with adequately diffuse spatial distribution.

In one embodiment, the multi-channel source signal is a 5-channel signal in the standard "3-2 stereo" format ($L_S$, L, C, R, $R_S$) corresponding to the loudspeaker layout depicted in FIG. 1A, and the matrix encoding of primary components in block 806 is performed according to equations (1) applied at each time and frequency. In an alternative embodiment, the multi-channel source signal is provided in a P-channel format ($C_1$, $C_2$, . . . $C_p$ . . . ) where each channel $C_p$ is intended for reproduction by a loudspeaker located at localization ($\theta_p$, $\phi_p$), and the matrix encoding in block 806 is performed by:

$$L_T=\Sigma_p L(\alpha_p,\beta_p)C_p$$

$$R_T=\Sigma_p R(\alpha_p,\beta_p)C_p \quad (30.)$$

where ($\alpha_p$, $\beta_p$) is derived by mapping each localization ($\theta_p$, $\phi_p$) to its corresponding notional encoding position ($\alpha_p$, $\beta_p$) on the Scheiber sphere, and the phase-amplitude encoding coefficients L($\alpha_p$, $\beta_p$) and R($\alpha_p$, $\beta_p$) are given by equations (17). Alternatively the encoding coefficients may be derived by equations (20) or by any chosen localization-to-dominance mapping convention.

In other embodiments of the primary matrix encoding block 806, the spatial localization cues ($\theta$, $\phi$) are derived, at each time and frequency, by spatial analysis of the primary multi-channel signal, and the phase-amplitude encoding coefficients L($\alpha$, $\beta$) and R($\alpha$, $\beta$) are obtained by mapping ($\theta$, $\phi$) to ($\alpha$, $\beta$), as described earlier. In one embodiment, this mapping is realized by applying, at each time and frequency, the encoding scheme described by equations (20, 21) or (21, 23) and FIG. 6A-6B. The spatial analysis may be performed by various methods, including the DirAC method or the spatial analysis method described in copending U.S. patent application Ser. No. 11/750,300, entitled Spatial Audio Coding Based on Universal Spatial Cues.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for two-channel phase amplitude stereo encoding of at least one audio source signal assigned a localization relative to a listener position, the method comprising:

scaling the at least one audio source signal by panning coefficients derived from the localization to generate a multi-channel signal corresponding to a desired multi-channel format; and matrix encoding the multi-channel signal to generate a 2-channel encoded signal such that the localization of the at least one audio source signal is represented by inter-channel phase and amplitude differences in the 2-channel encoded signal;

wherein the at least one audio source signal comprises a plurality of audio source signals and wherein the multi-channel signal for each of the plurality of audio source signals are combined prior to matrix encoding.

2. The method as recited in claim 1 wherein matrix encoding comprises scaling the multi-channel signal by frequency-independent encoding coefficients derived from the localization to generate the 2-channel encoded signal such that the localization of the at least one audio source is represented by inter-channel phase and amplitude differences in the 2-channel encoded signal, and wherein the localization includes an azimuth angle and an elevation angle, the method further comprising:

generating a first unlocalized audio signal and a second unlocalized audio signal from an unlocalized audio source signal such that the first and second unlocalized audio signals are substantially uncorrelated.

3. The method as recited in claim 1 wherein panning coefficients are derived from an azimuth angle included in the localization by the use of vector based amplitude panning (VBAP) techniques.

4. The method as recited in claim 1 wherein the scaling accommodates a top channel corresponding to an upper hemisphere located above the listening plane and a bottom channel located below the listening plane.

5. The method as recited in claim 1 wherein the multi-channel signal is a six channel signal and wherein the 2-channel encoded signal is a two channel phase-amplitude stereo encoded signal.

6. The method as recited in claim 1, wherein the total power of the contribution of the at least one audio source signal in the 2-channel encoded signal is equal to the power of the at least one audio source signal regardless of the assigned localization.

7. A method for two-channel phase amplitude stereo encoding of at least one localized audio source signal assigned a localization relative to a listener position and at least one unlocalized audio source signal, the method comprising:

scaling the at least one localized audio source signal by frequency-independent encoding coefficients derived from the localization to generate a 2-channel encoded signal such that the localization of the at least one localized audio source signal is represented by inter-channel phase and amplitude differences in the 2-channel encoded signal;

generating a first unlocalized audio signal and a second unlocalized audio signal from the at least one unlocalized audio source signal such that the first and second unlocalized audio signals are substantially uncorrelated; and adding the first and second unlocalized audio signals respectively to first and second encoded channel signals of the 2-channel encoded signal.

8. A method for two-channel phase amplitude stereo encoding of at least one localized audio source signal assigned a localization in three dimensions relative to a listener, the method comprising:

scaling the at least one localized audio source signal by frequency-independent encoding coefficients derived from the localization to generate a 2-channel encoded signal such that the localization of the at least one localized audio source signal is represented by inter-channel phase and amplitude differences in the 2-channel encoded signal, the localization including an up-down dimension, a left-right dimension and a front-back dimension; and generating a first unlocalized audio signal and a second unlocalized audio signal from an unlocalized audio source signal such that the first and second unlocalized audio signals are substantially uncorrelated;

wherein the scaling accommodates a top channel corresponding to an upper hemisphere located above the listening plane and a bottom channel located below the listening plane.

* * * * *